US007448687B2

(12) United States Patent
Tsai

(10) Patent No.: US 7,448,687 B2
(45) Date of Patent: Nov. 11, 2008

(54) INTERNALLY PULLING TYPE LIFT DEVICE FOR CHAIR ARMREST

(76) Inventor: Po-Chuan Tsai, 226-16, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 0 days.

(21) Appl. No.: 11/725,053

(22) Filed: Mar. 16, 2007

(65) Prior Publication Data

US 2008/0224526 A1 Sep. 18, 2008

(51) Int. Cl.
*A47C 1/03* (2006.01)

(52) U.S. Cl. ..... 297/411.36; 297/411.35

(58) Field of Classification Search ..... 297/411.36, 297/411.35, 353

See application file for complete search history.

(56) References Cited

U.S. PATENT DOCUMENTS

| | | | | |
|---|---|---|---|---|
| 5,620,233 | A * | 4/1997 | Corwin | 297/411.36 |
| 5,647,638 | A * | 7/1997 | Ritt et al. | 297/411.36 |
| 5,931,537 | A * | 8/1999 | Gollin et al. | 297/411.36 |
| 6,139,107 | A * | 10/2000 | Lee | 297/411.36 |
| 6,209,840 | B1 * | 4/2001 | Chen | 248/407 |
| 6,336,680 | B1 * | 1/2002 | Lee | 297/411.36 |
| 6,343,840 | B1 * | 2/2002 | Chuang | 297/411.36 |
| 6,394,553 | B1 * | 5/2002 | McAllister et al. | 297/411.36 |
| 6,398,309 | B1 * | 6/2002 | Chen | 297/411.36 |
| 6,419,323 | B1 * | 7/2002 | Chu et al. | 297/411.36 |
| 6,460,932 | B1 * | 10/2002 | Kopish et al. | 297/411.36 |
| 6,761,410 | B2 * | 7/2004 | Lee | 297/411.36 |
| 6,974,189 | B2 * | 12/2005 | Machael et al. | 297/411.36 |
| 6,974,190 | B1 * | 12/2005 | Hung | 297/411.36 |
| 6,976,739 | B2 * | 12/2005 | Wang | 297/411.35 |
| 7,156,466 | B1 * | 1/2007 | Chang | 297/411.36 |
| 7,246,859 | B2 * | 7/2007 | Igarashi et al. | 297/411.36 |
| 2002/0043863 | A1 * | 4/2002 | Roslund et al. | 297/411.36 |
| 2005/0093359 | A1 * | 5/2005 | Hobb et al. | 297/411.36 |
| 2007/0024100 | A1 * | 2/2007 | Chan | 297/411.36 |
| 2007/0057560 | A1 * | 3/2007 | Fookes et al. | 297/411.35 |
| 2007/0085402 | A1 * | 4/2007 | Hu et al. | 297/411.36 |
| 2007/0164595 | A1 * | 7/2007 | Chi | 297/411.36 |

* cited by examiner

*Primary Examiner*—David Dunn
*Assistant Examiner*—James Alex
(74) *Attorney, Agent, or Firm*—Alan Kamrath; Kamrath & Associates PA

(57) ABSTRACT

An internally pulling type lift device for a chair armrest includes an outer pipe, a guide track, an inner pipe, a follower, a locking member, a pull handle, a control knob, and a spring. Thus, the inner pipe is movable in the outer pipe so that the inner pipe will not rub the outer wall of the outer pipe during a long-term utilization, thereby enhancing the aesthetic quality of the outer pipe. In addition, the inner pipe is locked onto or unlocked from the outer pipe by pulling or releasing the control knob, so that the lift device is operated easily and rapidly, thereby facilitating a user operating the lift device to adjust the height of the armrest.

16 Claims, 9 Drawing Sheets

INTERNALLY PULLING TYPE LIFT DEVICE FOR CHAIR ARMREST

BACKGROUND OF THE INVENTION

1. Field of the Invention

The present invention relates to a lift device and, more particularly, to an internally pulling type lift device for a chair armrest.

2. Description of the Related Art

A conventional externally pulling type lift device 1 for a chair armrest in accordance with the prior art shown in FIG. 9 comprises a support post 10, an adjusting pipe 11 movably mounted on the support post 10 and detachably locked on the support post 10 by a locking member 13, and an armrest support 12 mounted on the upper end of the support post 10. Thus, when the adjusting pipe 11 is unlocked from the locking member 13, the adjusting pipe 11 is movable relative to the support post 10 to adjust the height of the armrest support 12 relative to the support post 10 so as to adjust the height of the chair armrest. However, the adjusting pipe 11 is movable on the support post 10 frequently, so that the adjusting pipe 11 easily rubs and wear the outer surface of the support post 10, thereby decreasing the aesthetic quality of the support post 10.

BRIEF SUMMARY OF THE INVENTION

In accordance with the present invention, there is provided a lift device, comprising an outer pipe, a guide track secured in the outer pipe and having two opposite sides each formed with a plurality of locking grooves, an inner pipe movably mounted in the guide track, a follower having an upper end secured to a lower end of the inner pipe to move with the inner pipe, a locking member pivotally mounted in a lower end of the follower and having two opposites ends each formed with a locking portion protruded from the follower and detachably locked in one of the locking grooves of the guide track, a pull handle movably mounted in the inner pipe and having a lower end extended through the follower and connected to the locking member to pivot the locking member relative to the guide track, a control knob movably mounted on an upper end of the inner pipe and connected to an upper end of the pull handle to move the pull handle, and a spring mounted on the pull handle and biased between the follower and the lower end of the pull handle to push the pull handle toward the locking member.

The primary objective of the present invention is to provide an internally pulling type lift device for a chair armrest.

Another objective of the present invention is to provide a lift device, wherein the inner pipe is movable in the outer pipe so that the inner pipe will not rub the outer wall of the outer pipe during a long-term utilization, thereby enhancing the aesthetic quality of the outer pipe.

A further objective of the present invention is to provide a lift device, wherein the inner pipe is locked onto or unlocked from the outer pipe by pulling or releasing the control knob, so that the lift device is operated easily and rapidly, thereby facilitating a user operating the lift device to adjust the height of the armrest.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
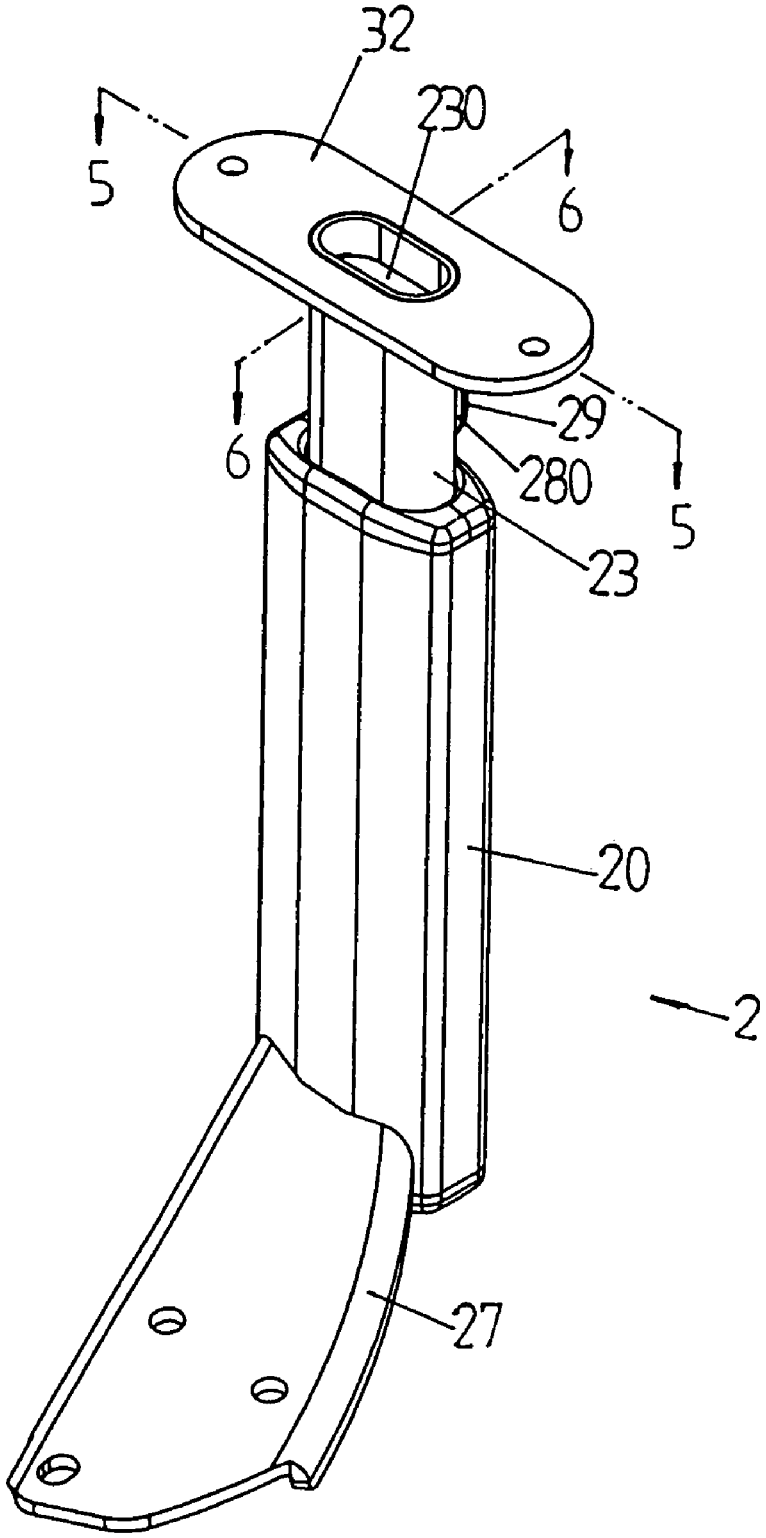
FIG. 1 is a perspective view of a lift device for a chair armrest in accordance with the preferred embodiment of the present invention.
Figure 2:
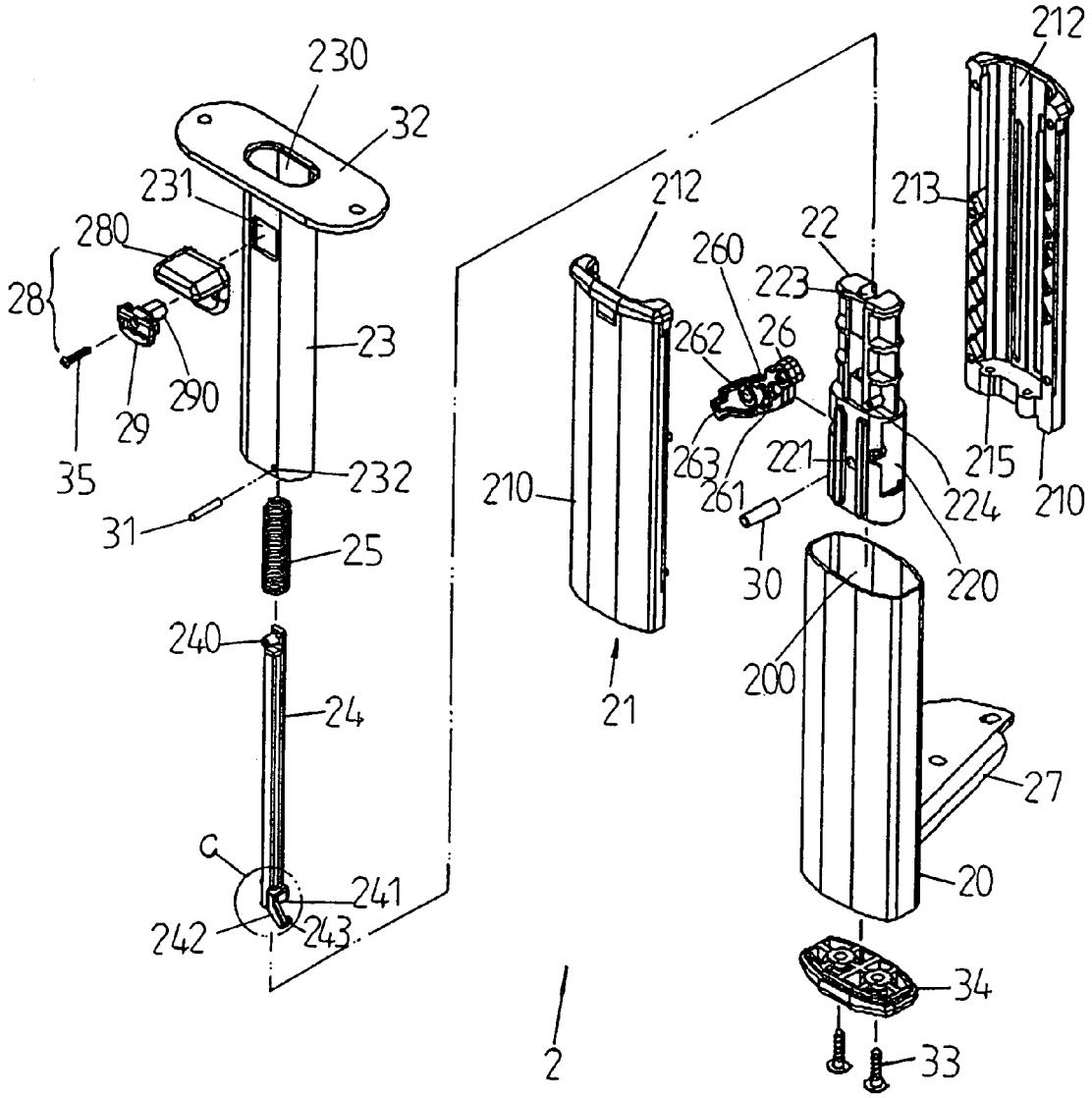
FIG. 2 is an exploded perspective view of the lift device as shown in FIG. 1.
Figure 3:
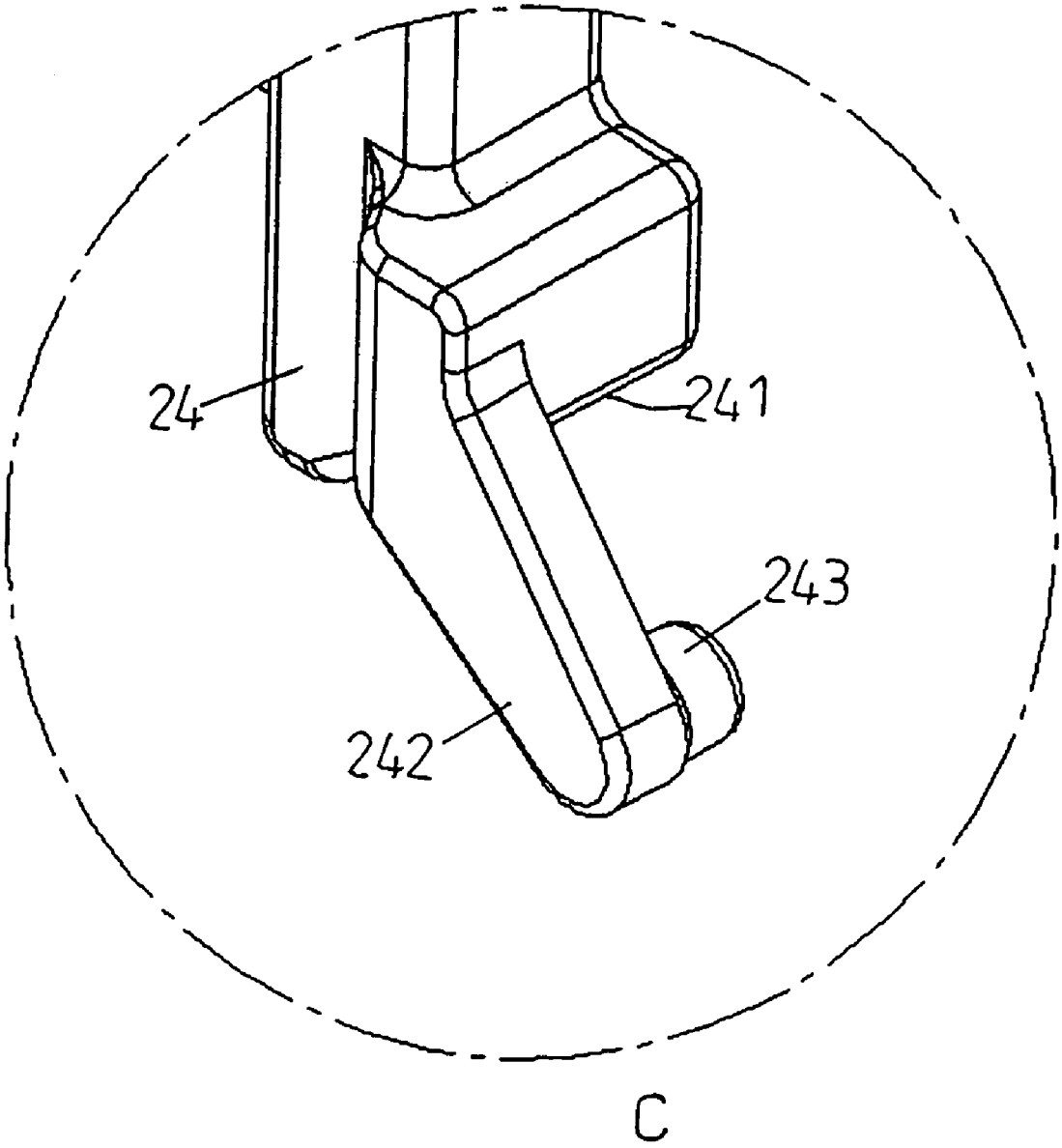
FIG. 3 is a locally enlarged perspective view of the lift device taken along a circle "C" as shown in FIG. 2.
Figure 4:
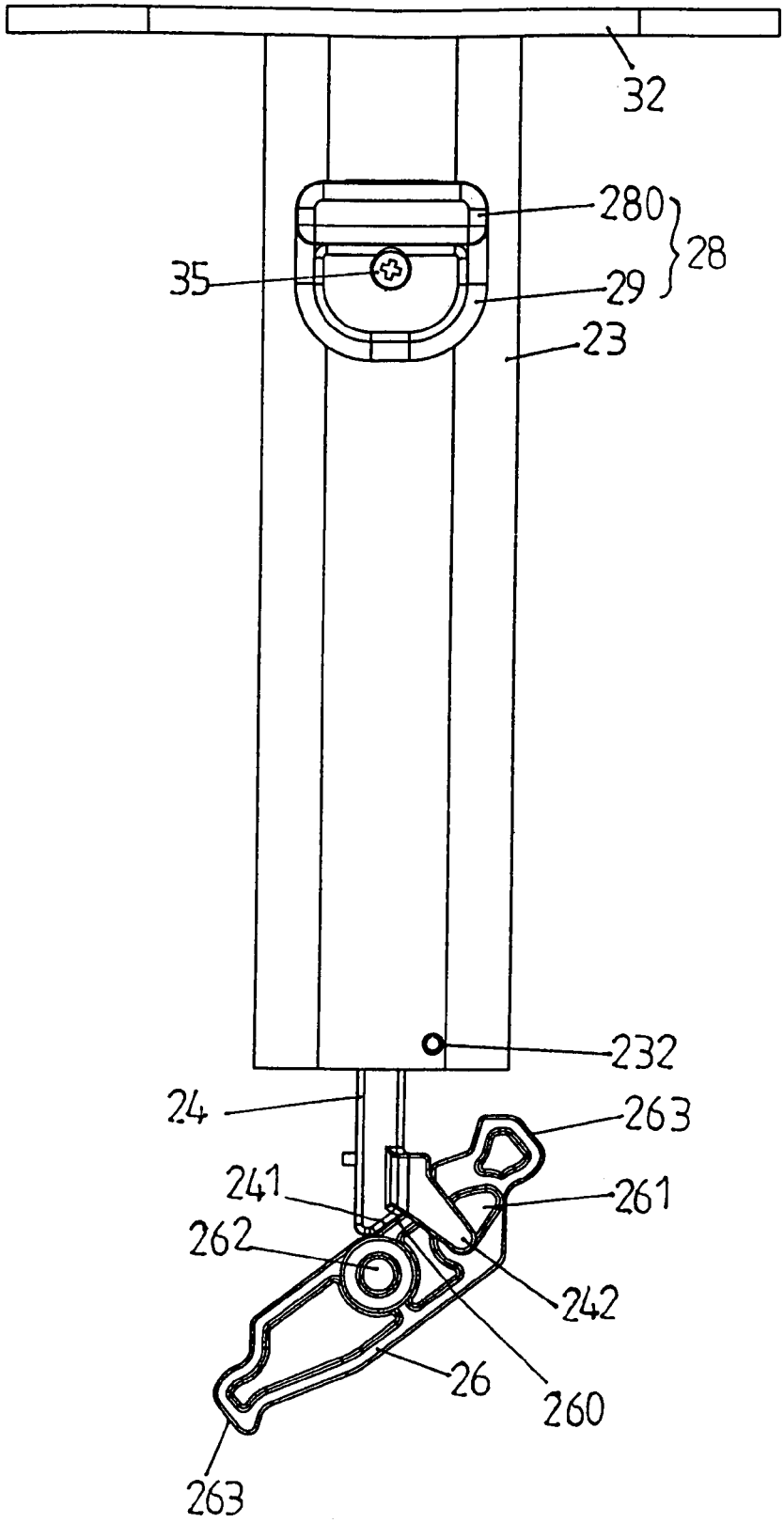
FIG. 4 is a partially cut-away side view of the lift device as shown in FIG. 1.

Referring to the drawings and initially to FIGS. 1-6, a lift device 2 for a chair armrest in accordance with the preferred embodiment of the present invention comprises an outer pipe 20, a guide track 21 secured in the outer pipe 20 and having two opposite sides each formed with a plurality of locking grooves 213, an inner pipe 23 movably mounted in the guide track 21, a follower 22 having an upper end secured to a lower end of the inner pipe 23 to move with the inner pipe 23, a locking member 26 pivotally mounted in a lower end of the follower 22 and having two opposites ends each formed with a locking portion 263 protruded from the follower 22 and detachably locked in one of the locking grooves 213 of the guide track 21, a pull handle 24 movably mounted in the inner pipe 23 and having a lower end extended through the follower 22 and connected to the locking member 26 to pivot the locking member 26 relative to the guide track 21, a control knob 28 movably mounted on an upper end of the inner pipe 23 and connected to an upper end of the pull handle 24 to move the pull handle 24, and a spring 25 mounted on the pull handle 24 and biased between the follower 22 and the lower end of the pull handle 24 to push the pull handle 24 toward the locking member 26.

The outer pipe 20 has an inside formed with a chamber 200 for mounting the guide track 21 and has a side provided with a fixing plate 27. The guide track 21 consists of two shells 210 combined with each other. The guide track 21 has inside formed with a slideway 212 connected to the locking grooves 213 to allow movement of the inner pipe 23 and the follower 22 and has a lower end formed with at least one screw bore 215.

The lift device further comprises a bottom cap 34 rested on a lower end of the outer pipe 20, and at least one locking screw 33 extended through the bottom cap 34 and screwed into the screw bore 215 of the guide track 21, so that the guide track 21 is fixed in the outer pipe 20 by the bottom cap 34 and the locking screw 33.

The follower 22 has a side formed with an elongated guide channel 223 to allow movement of the pull handle 24. The lower end of the follower 22 has an inside formed with a space 220 connected to the guide channel 223 and the locking grooves 213 of the guide track 21 to receive the locking member 26 and has a surface formed with a fixing hole 221 connected to the space 220. The upper end of the follower 22 has a side formed with a fixing bore 224.

The locking member 26 is disposed at an inclined state in the follower 22 and the guide track 21. The locking member 26 has a face formed with a recessed first ramp 260. The locking member 26 has a mediate portion formed with a pivot hole 262 located between the locking portions 263 and has a side formed with a cavity 261 located between one the locking portions 263 and the pivot hole 262. A pivot pin 30 is extended through the fixing hole 221 of the follower 22 and the pivot hole 262 of the locking member 26 so that the locking member 26 is pivotally mounted in the follower 22.

The pull handle 24 has an upper end formed with a post 240. The lower end of the pull handle 24 has a bottom formed with a second ramp 241 rested on the first ramp 260 of the locking member 26 by an elastic force of the spring 25 and has a side formed with a lug 242 which has a distal end formed with a stub 243 slidable in the cavity 261 of the locking member 26 to drive the locking member 26 to pivot about the pivot pin 30.

The inner pipe 23 has an inside formed with a conduit 230 mounted on the upper end of the follower 22 and connected to the guide channel 223 of the follower 22. The upper end of the inner pipe 23 has a top provided with a fixing board 32 for mounting an armrest support (not shown) and has a side formed with a sliding slot 231 connected to the conduit 230 to allow movement of the control knob 28. The lower end of the inner pipe 23 has a surface formed with a through hole 232, and a fixing pin 31 is extended through the through hole 232 of the inner pipe 23 and fixed in the fixing bore 224 of the follower 22 to secure the follower 22 to the inner pipe 23.

The control knob 28 includes a slide 280 slidably mounted on the inner pipe 23 and protruded from the outer pipe 20, a retainer 29 secured on the slide 280 and provided with a sleeve 290 extended through the slide 280 and the sliding slot 231 of the inner pipe 23 and mounted on the post 240 of the pull handle 24, and a fastening screw 35 extended through the sleeve 290 of the retainer 29 and screwed into the post 240 of the pull handle 24 to secure the retainer 29 to the pull handle 24 and to attach the slide 280 onto the inner pipe 23.

As shown in FIGS. 1-6, the second ramp 241 of the pull handle 24 is rested on the first ramp 260 of the locking member 26 by an elastic force of the spring 25, so that the locking portion 263 of the locking member 26 is locked in one of the locking grooves 213 of the guide track 21 at a normal state to fix the follower 22 in the guide track 21 so as to lock the inner pipe 23 onto the outer pipe 20.

Figure 5:
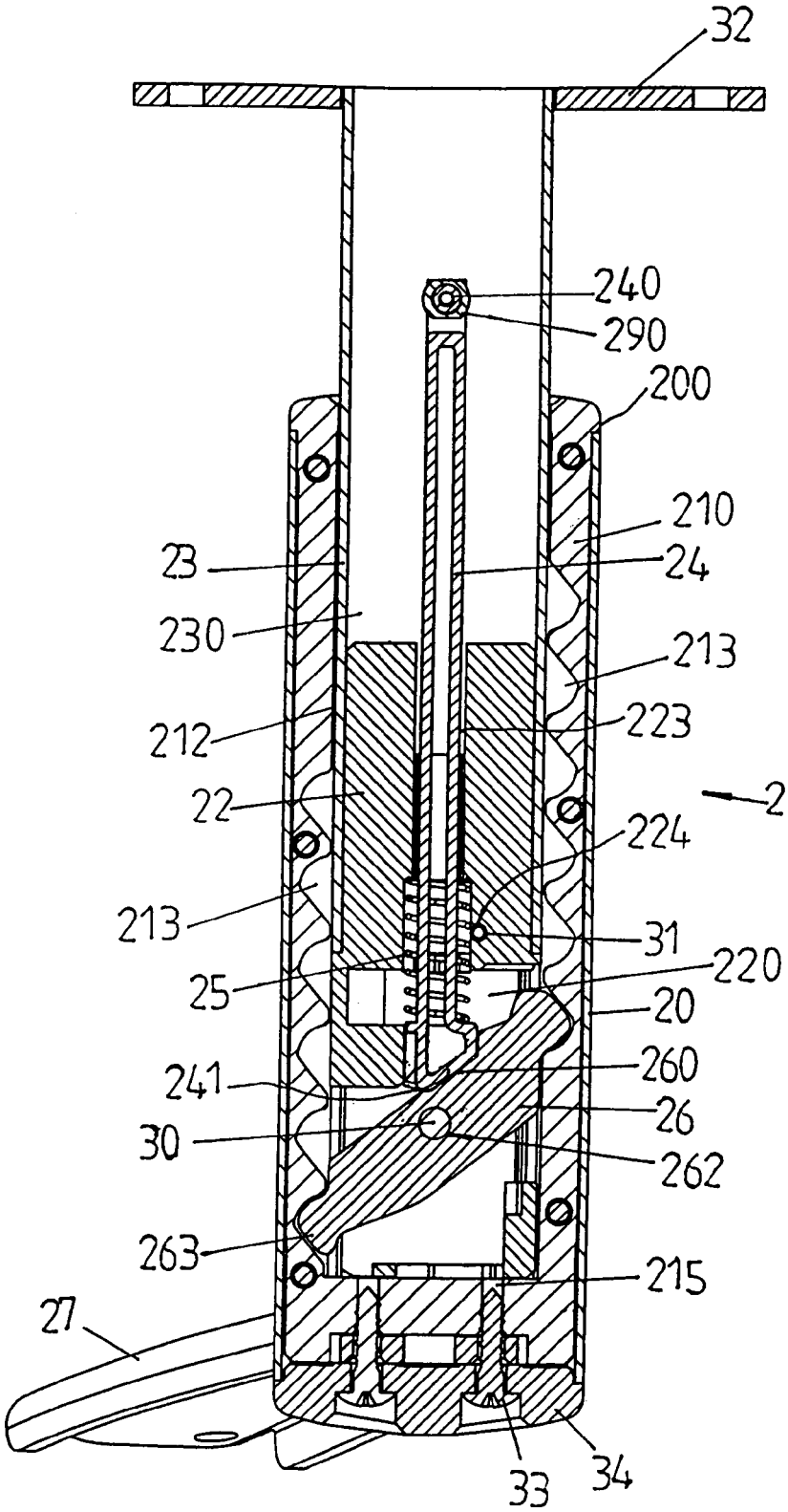
FIG. 5 is a front cross-sectional view of the lift device taken along line 5-5 as shown in FIG. 1.
Figure 6:
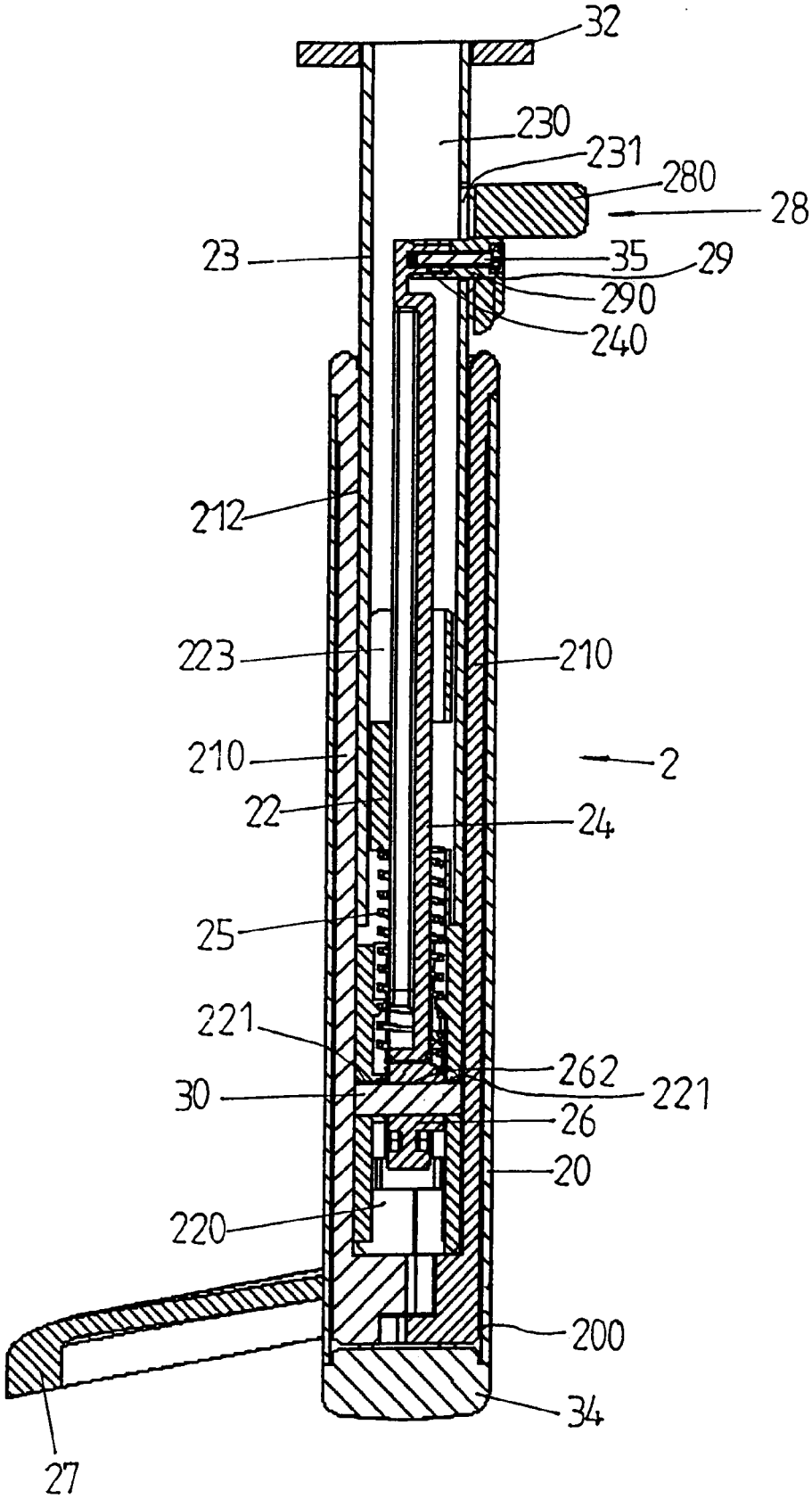
FIG. 6 is a side cross-sectional view of the lift device taken along line 6-6 as shown in FIG. 1.
Figure 7:
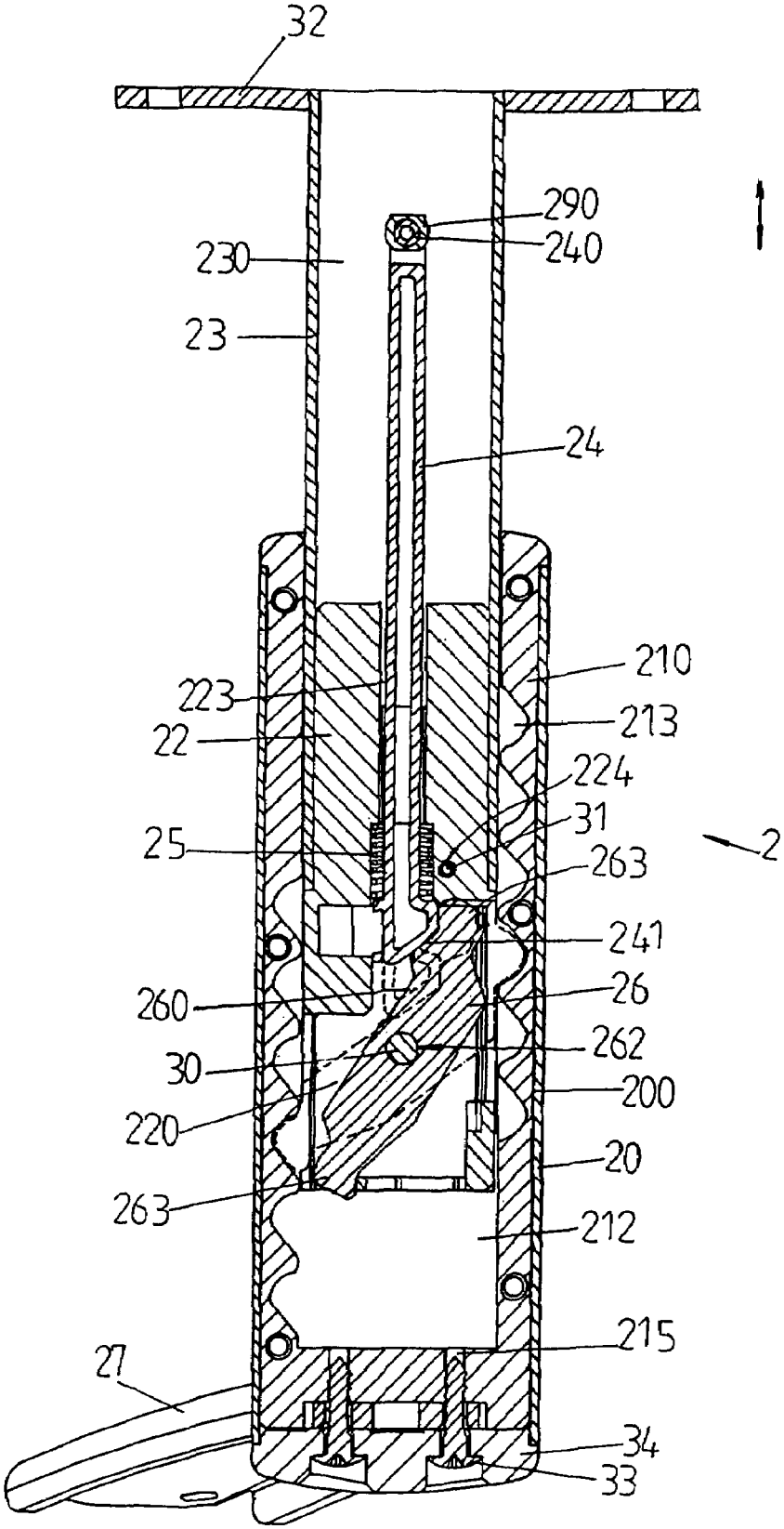
FIG. 7 is a schematic operational view of the lift device as shown in FIG. 5.
Figure 8:
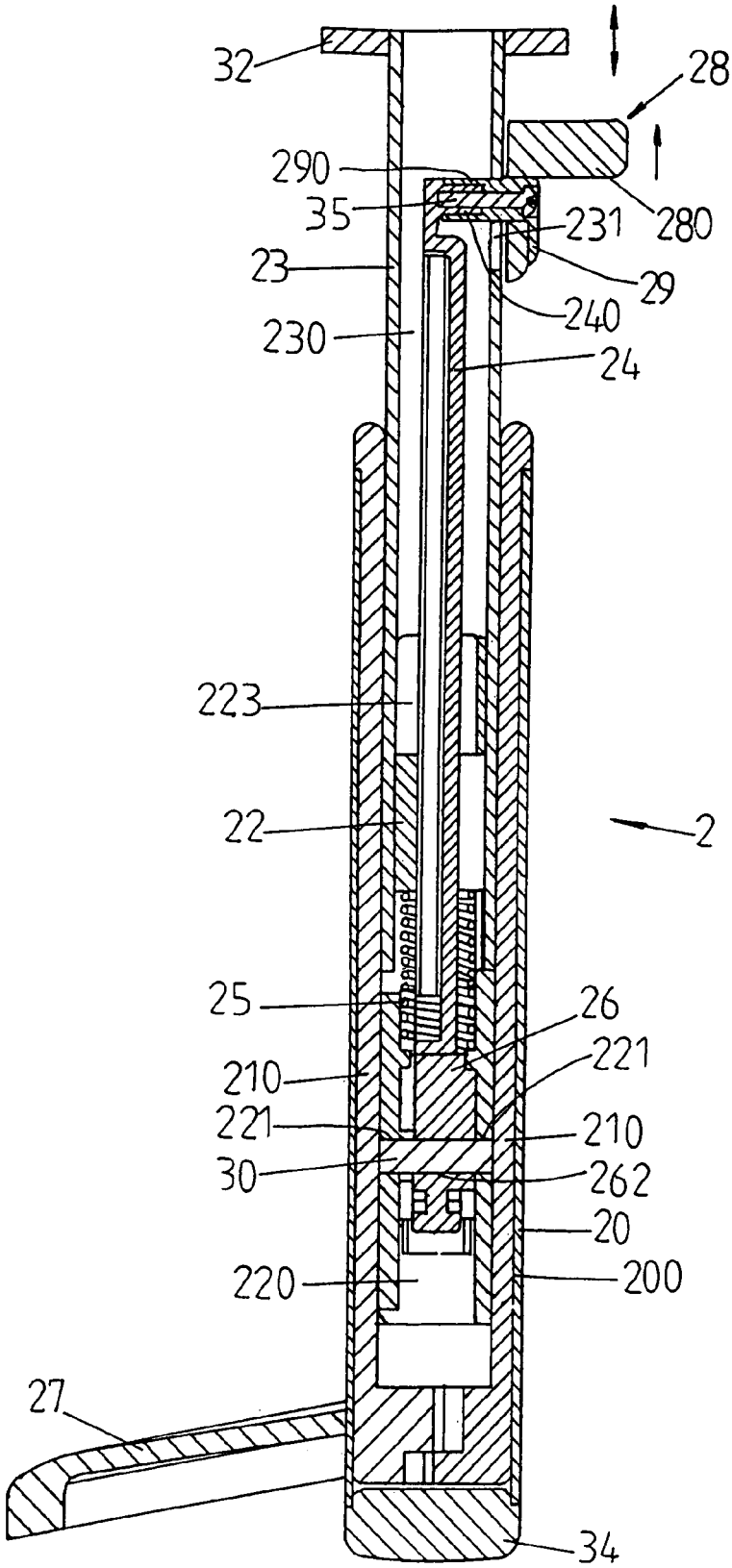
FIG. 8 is a schematic operational view of the lift device as shown in FIG. 6.
Figure 9:
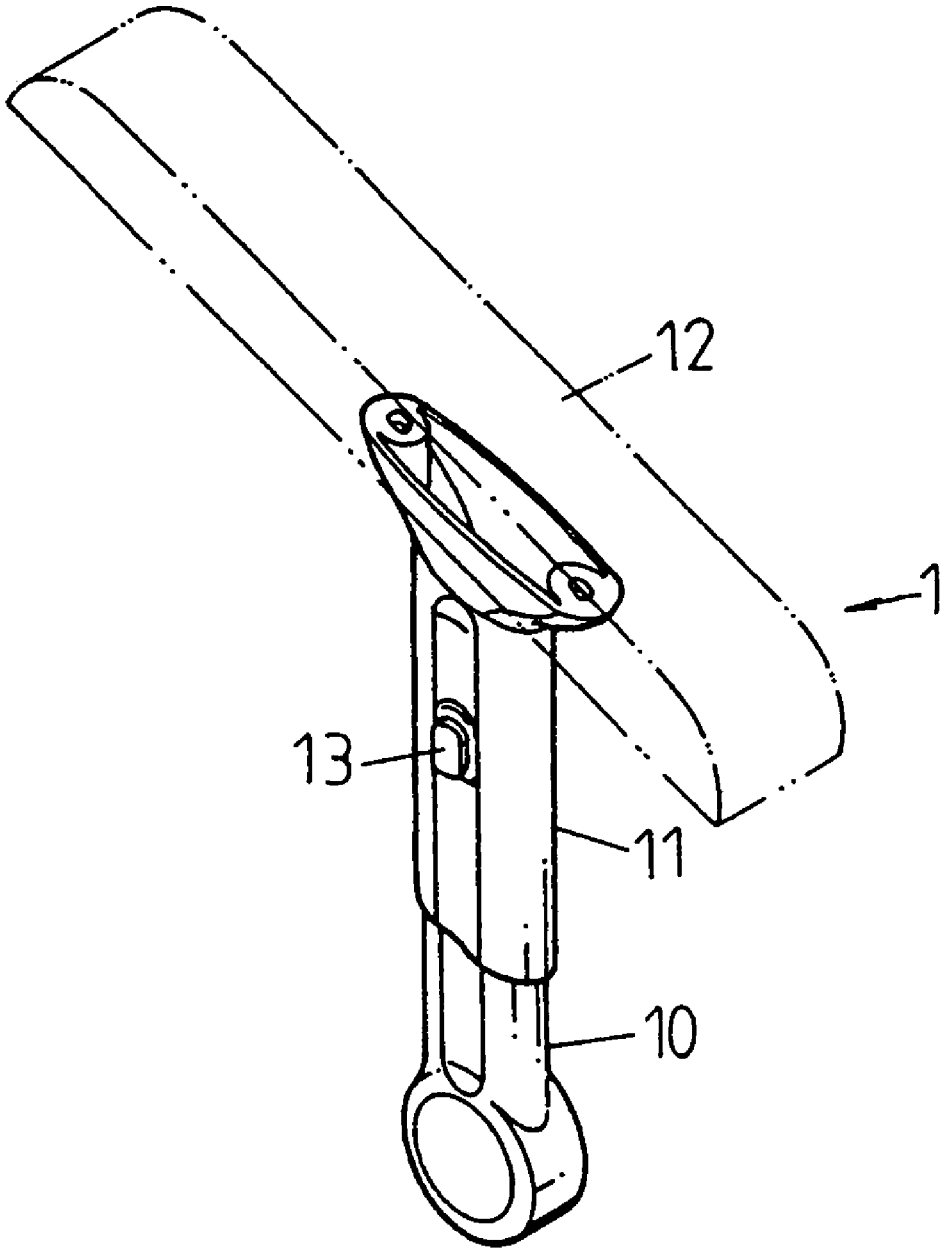
FIG.9 PRIOR ART
FIG. 9 is a perspective view of a conventional lift device for a chair armrest in accordance with the prior art.

In operation, referring to FIGS. 1-8, when the slide 280 of the control knob 28 is pulled to slide upward on the inner pipe 23 to move from the position as shown in FIG. 6 to the position as shown in FIG. 8, the pull handle 24 is moved upward by the control knob 28, and the stub 243 of the pull handle 24 is slidable in the cavity 261 of the locking member 26 to drive the locking member 26 to pivot about the pivot pin 30 through an angle and to move from the position as shown in FIG. 5 to the position as shown in FIG. 7, so that the locking portion 263 of the locking member 26 is movable to detach from the respective locking groove 213 of the guide track 21 to unlock the follower 22 from the guide track 21 so as to unlock the inner pipe 23 from the outer pipe 20. Thus, the inner pipe 23 is movable upward and downward relative to the outer pipe 20 to adjust the distance between the inner pipe 23 and the outer pipe 20 so as to adjust the height of the armrest (not shown).

After the force applied on the slide 280 of the control knob 28 disappears, the pull handle 24 is pushed toward the locking member 26 by the restoring force of the spring 25, and the second ramp 241 of the pull handle 24 is rested on the first ramp 260 of the locking member 26, so that the locking member 26 is pivoted about the pivot pin 30 through an angle, and the locking portion 263 of the locking member 26 is locked in another one of the locking grooves 213 of the guide track 21 to fix the follower 22 in the guide track 21 so as to lock the inner pipe 23 onto the outer pipe 20.

Accordingly, the inner pipe 23 is movable in the outer pipe 20 so that the inner pipe 23 will not rub the outer wall of the outer pipe 20 during a long-term utilization, thereby enhancing the aesthetic quality of the outer pipe 20. In addition, the inner pipe 23 is locked onto or unlocked from the outer pipe 20 by pulling or releasing the control knob 28, so that the lift device 2 is operated easily and rapidly, thereby facilitating a user operating the lift device 2 to adjust the height of the armrest.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lift device, comprising:

an outer pipe;

a guide track secured in the outer pipe and having two opposite sides each formed with a plurality of locking grooves;

an inner pipe movably mounted in the guide track;

a follower having an upper end secured to a lower end of the inner pipe to move with the inner pipe;

a locking member pivotally mounted in a lower end of the follower and having two opposites ends each formed with a locking portion protruded from the follower and detachably locked in one of the locking grooves of the guide track;

a pull handle movably mounted in the inner pipe and having a lower end extended through the follower and connected to the locking member to pivot the locking member relative to the guide track;

a control knob movably mounted on an upper end of the inner pipe and connected to an upper end of the pull handle to move the pull handle;

a spring mounted on the pull handle and biased between the follower and the lower end of the pull handle to push the pull handle toward the locking member;

wherein the follower has a side formed with an elongated guide channel to allow movement of the pull handle;

the inner pipe has an inside formed with a conduit mounted on the upper end of the follower and connected to the guide channel of the follower;

the upper end of the inner pipe has a side formed with a sliding slot connected to the conduit to allow movement of the control knob;

the pull handle has an upper end formed with a post, and the control knob includes a slide slidably mounted on the inner pipe and protruded from the outer pipe, a retainer secured on the slide and provided with a sleeve extended through the slide and the sliding slot of the inner pipe and mounted on the post of the pull handle, and a fastening screw extended through the sleeve of the retainer and screwed into the post of the pull handle to secure the retainer to the pull handle and to attach the slide onto the inner pipe.

2. The lift device in accordance with claim 1, wherein the locking member has a face formed with a recessed first ramp, and the lower end of the pull handle has a bottom formed with a second ramp rested on the first ramp of the locking member by an elastic force of the spring.

3. The lift device in accordance with claim 1, wherein the lower end of the follower has an inside formed with a space connected to the guide channel to receive the locking member.

4. The lift device in accordance with claim 3, wherein the lower end of the follower has a surface formed with a fixing hole connected to the space, the locking member has a mediate portion formed with a pivot hole located between the locking portions, and the lift device further comprises a pivot pin extended through the fixing hole of the follower and the pivot hole of the locking member so that the locking member is pivotally mounted in the follower.

5. The lift device in accordance with claim 4, wherein the locking member has a side formed with a cavity located between one the locking portions and the pivot hole, and the lower end of the pull handle has a side formed with a lug which has a distal end formed with a stub slidable in the cavity of the locking member to drive the locking member to pivot about the pivot pin.

6. The lift device in accordance with claim 1, wherein the outer pipe has an inside formed with a chamber for mounting the guide track.

7. The lift device in accordance with claim 1, wherein the guide track has an inside formed with a slideway connected to the locking grooves to allow movement of the inner pipe and the follower.

8. The lift device in accordance with claim 1, wherein the guide track has a lower end formed with at least one screw bore, and the lift device further comprises a bottom cap rested on a lower end of the outer pipe, and at least one locking screw extended through the bottom cap and screwed into the screw bore of the guide track, so that the guide track is fixed in the outer pipe by the bottom cap and the locking screw.

9. The lift device in accordance with claim 1, wherein the upper end of the follower has a side formed with a fixing bore, the lower end of the inner pipe has a surface formed with a through hole, and the lift device further comprises, a fixing pin extended through the through hole and fixed in the fixing bore of the follower to secure the follower to the inner pipe.

10. The lift device in accordance with claim 1, wherein the locking member is disposed at an inclined state in the follower and the guide track.

11. The lift device in accordance with claim 2, wherein the locking portion of the locking member is locked in one of the locking grooves of the guide track at a normal state by the elastic force of the spring to fix the follower in the guide track to lock the inner pipe onto the outer pipe.

12. The lift device in accordance with claim 5, wherein the when the control knob is pulled to slide upward on the inner pipe, the pull handle is moved upward by the control knob, and the stub of the pull handle is slidable in the cavity of the locking member to drive the locking member to pivot about the pivot pin, so that the locking portion of the locking member is movable to detach from the respective locking groove of the guide track to unlock the follower from the guide track to unlock the inner pipe from the outer pipe.

13. The lift device in accordance with claim 1, wherein the guide track consists of two shells combined with each other.

14. The lift device in accordance with claim 1, wherein the outer pipe has a side provided with a fixing plate.

15. The lift device in accordance with claim 1, wherein the upper end of the inner pipe has a top provided with a fixing board.

16. The lift device in accordance with claim 3, wherein the space of the follower is connected to the guide channel and the locking grooves of the guide track.

* * * * *